US010099758B2

(12) United States Patent
Snowden et al.

(10) Patent No.: US 10,099,758 B2
(45) Date of Patent: Oct. 16, 2018

(54) RAFT FOR VIEWING UNDERWATER OBJECTS

(71) Applicants: Sean Patrick Snowden, Marathon, FL (US); David Edwin Snowden, West Palm Beach, FL (US); Tanner Reece Snowden, Marathon, FL (US)

(72) Inventors: Sean Patrick Snowden, Marathon, FL (US); David Edwin Snowden, West Palm Beach, FL (US); Tanner Reece Snowden, Marathon, FL (US)

( * ) Notice: Subject to any disclaimer, the term of this patent is extended or adjusted under 35 U.S.C. 154(b) by 0 days.

(21) Appl. No.: 14/828,138

(22) Filed: Aug. 17, 2015

(65) Prior Publication Data

US 2017/0361908 A1 Dec. 21, 2017

Related U.S. Application Data

(60) Provisional application No. 62/053,772, filed on Sep. 22, 2014.

(51) Int. Cl.

| | |
|---|---|
| ***B63C 11/49*** | (2006.01) |
| ***B63B 35/58*** | (2006.01) |
| ***B63B 7/08*** | (2006.01) |

(52) U.S. Cl.

CPC ..... *B63C 11/49* (2013.01); *B63B 7/08* (2013.01); *B63B 35/58* (2013.01)

(58) Field of Classification Search

CPC ..... B63B 35/73; B63B 35/74; B63B 35/58; B63C 11/00; B63C 11/48; B63C 11/49; A47C 15/00; A47C 15/006

USPC ..... 441/135, 130; D21/803

See application file for complete search history.

(56) References Cited

U.S. PATENT DOCUMENTS

| | | | | |
|---|---|---|---|---|
| 2,717,399 | A * | 9/1955 | Backhouse | B63C 11/49 441/135 |
| 5,685,753 | A * | 11/1997 | Canela | B63B 35/74 441/135 |
| D421,085 | S * | 2/2000 | Fife | D21/803 |
| D821,523 | S * | 6/2018 | Kasper | D21/803 |
| 2002/0115366 | A1* | 8/2002 | Harkrider | B63C 11/49 441/135 |
| 2010/0062665 | A1* | 3/2010 | Kuchler | B63C 11/49 441/135 |

* cited by examiner

*Primary Examiner* — Lars A Olson

(57) ABSTRACT

The invention relates to a device for viewing underwater objects without getting wet while experiencing the sensation of walking on water. The device comprises an inflated raft with a clear bottom designed to allow a person to sit or lie face down and view underwater objects while experiencing the movement of the water without getting wet. This clear bottom has no air pockets and is flexible, thus the person receives the sensation of walking on water instead of air.

6 Claims, 1 Drawing Sheet

RAFT FOR VIEWING UNDERWATER OBJECTS

BACKGROUND OF THE INVENTION

1. Field of the Invention

The invention relates to a flotation device or raft having a clear bottom so that a person can view underwater objects and terrain without getting wet. This clear bottom has no air pockets and is flexible, thus the person receives the sensation of walking on water instead of air.

2. Description of the Prior Art

U.S. Pat. No. 2,717,399 to Backhouse discloses an underwater viewing device for a raft wherein the center region is cut out. This allows a person to lie face down while viewing the water. In this case, there's a through-way 3 formed by a tube 4 of flexible rubberized material. There is also a transparent window 5 of glass or transparent plastic material located within this cut-out region. This device does not utilize the viewing window as the floor or support structure for the raft.

U.S. Pat. No. 2,712,139 to Kelly discloses an underwater viewing device that has a rigid plastic material for a window 24. In this case as well, the viewing window is not the floor or support structure for the raft.

U.S. Pat. No. 4,723,329 to Vaccaro discloses a mattress having a center cut out designed to allow a person to lie face down. The viewing window is not the floor or support structure.

U.S. Pat. No. 6,142,844 to Klauber discloses a raft having a raised center headrest cut out designed to allow a person to lie face down while still breathing comfortably. Similarly, the viewing area is not also the floor or support structure.

The prior art shows a raft for receiving a person's head lying face down on the raft. However, this prior art does not show a clear viewing window that is also the floor and support structure for the user.

SUMMARY OF THE INVENTION

One object of the invention is to provide a raft that allows a person to identify underwater objects and terrain without getting wet.

Another object of the invention is to provide a raft where the user experiences the feeling of walking on water.

Another object of the invention is to provide a raft that allows the user to interact with other swimmers without getting in the water. This is especially true for children.

These and other objects are solved by providing a flotation device or raft with a clear viewing window as the floor and support structure for the user. The first embodiment is a three-piece polymer recreational raft. The second embodiment is a three-piece polymer observational device. The raft is durable, buoyant and flexible and is shaped to resemble a rowboat. There are two handles for stability while also serving as the rowlocks for optional oars.

The bottom section is a clear one-piece polymer that serves as the floor and support structure for the user. In this way, when a person sits or lies face down, that person places their entire body onto the viewing window, rather than placing their face in a small opening which requires the user to draw air from breathing holes. Thus, because of this design, the person has an unobstructed underwater view without the need of breathing holes. This allows for a user-friendly underwater view while receiving the sensation of walking on water.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
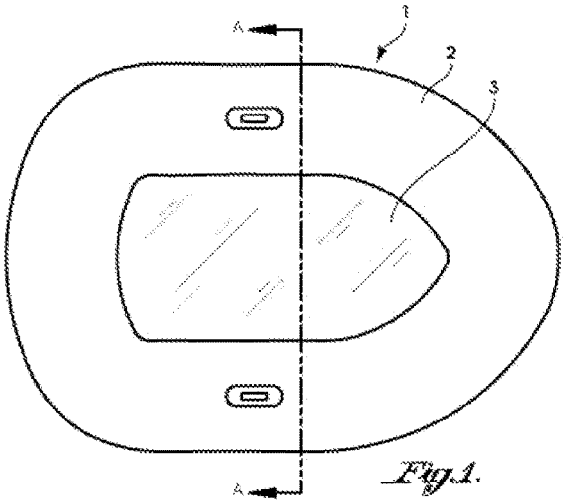
FIG. 1 is a plan view of the raft.

FIG. 1 is a top view of raft 1 having a substantially round shape.

Figure 2:
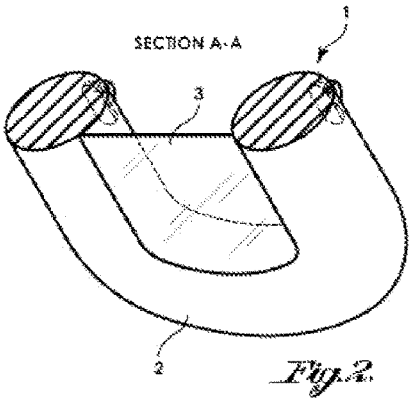
FIG. 2 is a perspective section view of the raft.

FIG. 2 shows a perspective section view of raft 1 with opaque top section 2 and clear bottom viewing window 3. In a preferred embodiment, raft 1 is a two-piece polymer raft. The top section 2 is an opaque inflatable polymer perimeter intended for proper buoyancy. The clear bottom viewing window 3 is a clear polymer that serves as the floor and support structure for the user. In this case, when a person lies face down on the clear bottom viewing window 3, they have an unobstructed view of underwater objects and terrain while experiencing the feeling of walking on water.

Figure 3:
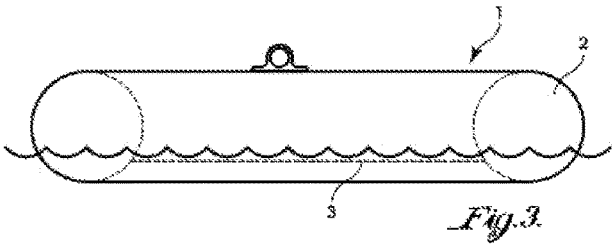
FIG. 3 is a side view of the raft.

FIG. 3 shows a side view of raft 1. In this view, the clear bottom viewing window 3 extends down past the water line to enable the person to have an unobstructed view of underwater objects and terrain while experiencing the feeling of walking on water.

These design features are important because it allows a person to sit or lie face down on the clear viewing window for an unobstructed view of underwater objects and terrain. In addition, the person receives the sensation of walking on water since the entire raft bottom is the clear viewing window and support structure. This design feature is important because it maximizes the underwater viewing window size and provides the unique user experience of walking on water instead of air.

Furthermore, this raft or flotation device could be used in a pool, lake, or ocean. Any person who desires to view underwater objects and terrain without getting wet could use this raft or flotation device to support them in a sitting or prone position.

Accordingly, while two embodiments of the present invention have been described, it is to be understood that many changes and modifications may be made thereunto without departing from the spirit and scope of the invention as defined in the appended claims.

What is claimed is:

1. An inflatable recreational device formed as a three-piece raft made from a polymer for allowing a person to sit or lie in a prone position comprising:

a) a inflatable perimeter intended for proper buoyancy; and b) a clear bottom floor acting as the support structure for the user that forms a viewing window into the water wherein a person can identify underwater objects and terrain without getting wet.

2. The device as claimed in claim 1, wherein said viewing window is also the floor and support structure for the user.

3. The device as claimed in claim 1, wherein said viewing window is not hollow and cannot be inflated.

4. The device as claimed in claim 1, wherein said device is constructed of polymer sheet.

5. The device as claimed in claim 1, wherein said clear bottom viewing window contours to the user and reacts to their movements.

6. An inflatable observation device formed as a three-piece raft made from a polymer for allowing a person to sit or lie in a prone position comprising:

a) a inflatable perimeter intended for proper buoyancy; and b) a clear bottom floor acting as the support structure for the user that forms a viewing window into the water wherein a person can identify underwater objects and terrain without getting wet.

* * * * *